US006494814B1

(12) United States Patent
Wang et al.

(10) Patent No.: US 6,494,814 B1
(45) Date of Patent: Dec. 17, 2002

(54) ROPE TYPE FOLDING MECHANISM FOR AN EXERCISE TREADMILL

(76) Inventors: Leao Wang, No. 1, Lane 233, Sec. 2, Charng Long Rd., Taiping (TW), 411; Peter Wu, No. 1, Lane 233, Sec. 2, Charng Long Rd., Taiping (TW), 411

( * ) Notice: Subject to any disclaimer, the term of this patent is extended or adjusted under 35 U.S.C. 154(b) by 0 days.

(21) Appl. No.: 09/888,518

(22) Filed: Jun. 27, 2001

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 5,733,228 A * 3/1998 Stevens ..... 482/54
5,746,682 A * 5/1998 Hung ..... 482/54
6,033,347 A * 3/2000 Dalebout et al. ..... 482/54
6,059,695 A * 5/2000 Hung ..... 482/54
6,077,200 A * 6/2000 Lin ..... 482/54

* cited by examiner

*Primary Examiner*—Stephen R. Crow
(74) *Attorney, Agent, or Firm*—Troxell Law Office PLLC; Kuo-Hsiung Chiu

(57) ABSTRACT

The present invention relates to a rope type folding mechanism for an exercise treadmill. Each end of the U-shaped handrail is provided with a rope wheel whose shaft is pivotably mounted on the extension part at the top of each of the supporting arms. Thereafter, a strong rope is fixed at one side of the rope wheel and pulled downward to the bottom of the frame. When the U-shaped handrail is raised and turned around the shaft, the rope wheel is also rotated to pull the strong rope upward. Thereafter, the frame is raised up to the top by means that the rear roller is turned around the first pivot.

3 Claims, 3 Drawing Sheets

ROPE TYPE FOLDING MECHANISM FOR AN EXERCISE TREADMILL

BACKGROUND OF THE INVENTION

1. Field of the Invention

The present invention relates to a rope type folding mechanism for an exercise treadmill, and more particularly, an exercise treadmill whose frame can be folded or unfolded by moving the handrail. Therefore, the convenience in use is achieved and the safety is ensured.

2. Description of the Prior Art

The frame of the conventional treadmills (for example, the disclosed U.S. Pat. Nos. 5,674,453, and 6,033,347) is designed to be foldable in order to reduce the occupied space and to facilitate the movement thereof. However, these products have to include an auxiliary lifting member (like pneumatic or oil-pressurized cylinder) behind the frame in order to prevent the frame from an unexpected collapse endangering the operator or the other around. Accordingly, the whole design and use show much inconvenience.

Moreover, this conventional design doesn't fit the old or the disable in waist or lower limbs because they have much difficulty in bending down to perform the folding movement.

SUMMARY OF THE INVENTION

It is a primary object of the present invention to remove the abovementioned drawbacks and to provide a folding mechanism for an exercise treadmill through which the operator doesn't need to bend down to perform the folding movement of the frame. Furthermore, the frame can be folded to the top at an automatic locking position by means of rope wheels, strong ropes and corresponding pivots for achieving a full safety for operators and people around.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
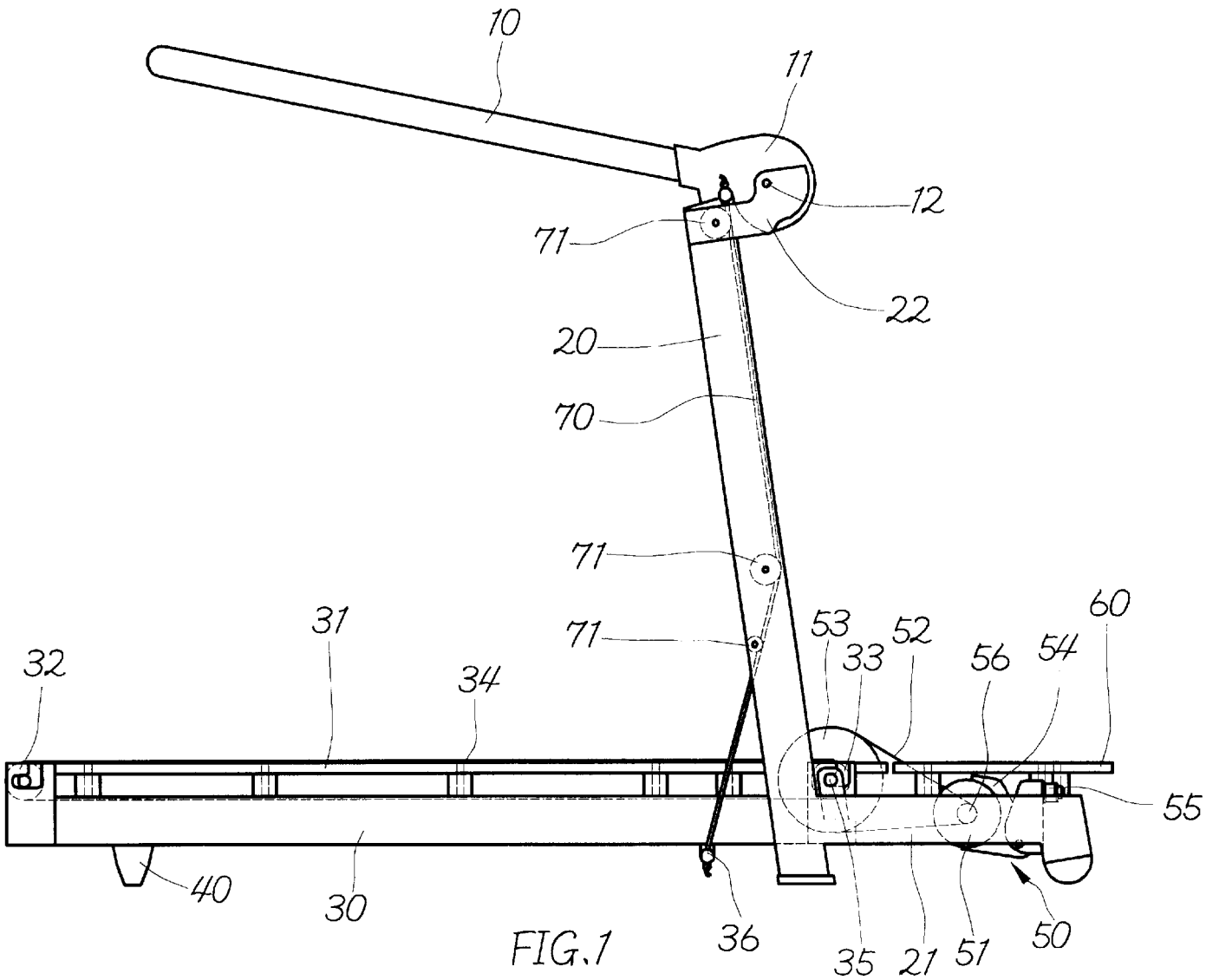
FIG. 1 is a side view of a preferred embodiment of the present invention.
Figure 2:
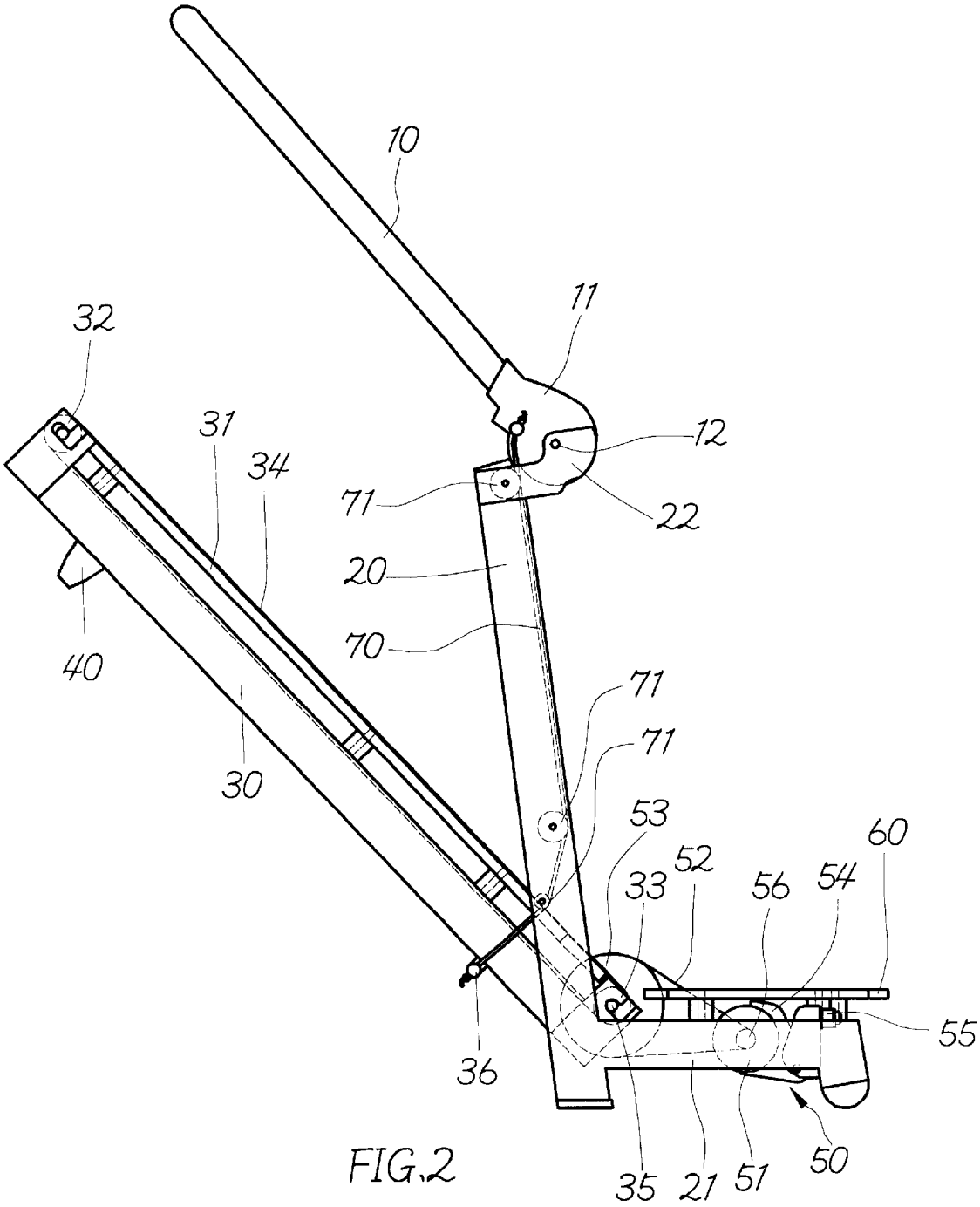
FIG. 2 is a side view of the present invention showing the fold-up action.
Figure 3:
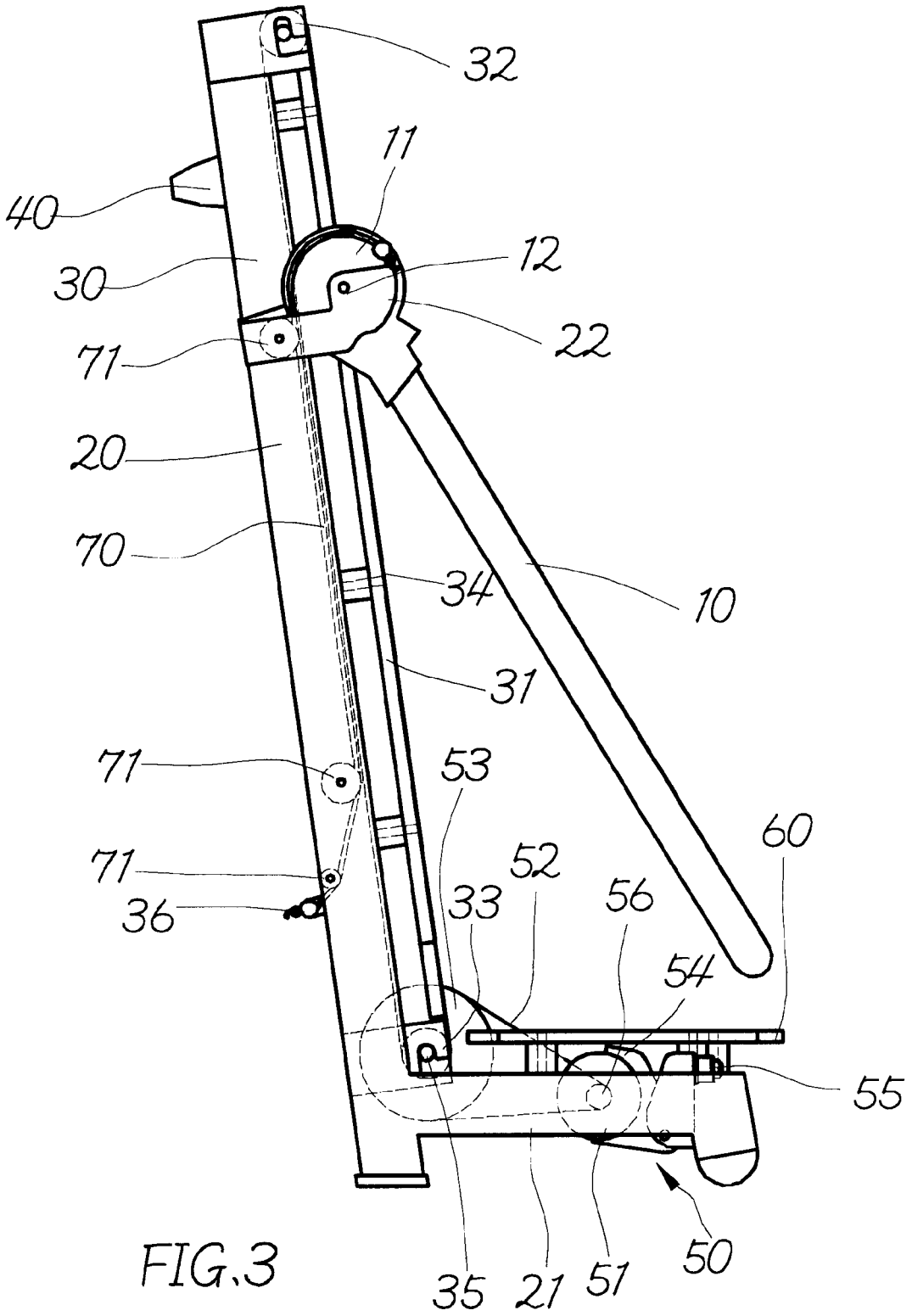
FIG. 3 is another side view of the present invention in the fold-up state.

First of all, referring to FIGS. 1, 2 and 3, a preferred embodiment of the present invention mainly includes a U-shaped handrail 10, two supporting arms 20, a frame 30, a front support 40, a motorized assembly 50 and a rear treading plate 60. The frame 30 has a platform 31 the front and rear ends of which are fitted with a front and rear rollers 32, 33 between which a treadmill walking belt 34 circles. Besides, the rear roller 33 of the frame 30 is positioned on horizontal parts 21 of the supporting arms 20 by means of a first pivot 35.

The motorized assembly 50 comprises a motor 51, a belt 52, a driven wheel 53 and a protection cover 54. The motor 51 is fixed behind the horizontal parts 21 of the supporting arms 20 by means of a fastening member. The belt 52 extend between a power output shaft 56 and the driven wheel 53 while the rear roller 33 is driven by the driven wheel 53 for a rotational movement of the treadmill walking belt 34.

Each end of the U-shaped handrail 10 is provided with a rope wheel 11 whose shaft 12 is pivotably mounted on the extension part 22 at the top of each of the supporting arms 20. Thereafter, a strong rope 70 is fixed at one side of the rope wheel 11 and pulled downward to the bottom 36 of the frame 30. When the U-shaped handrail 10 is raised and turned around the shaft 12, the rope wheel 1I is also rotated to pull the strong rope 70 upward. Thereafter, the frame 30 is raised up to the top by means that the rear roller 33 is turned around the first pivot 35.

Based on the above-mentioned components, the frame 30 can be folded up for storage or unfolded for exercise operation only by moving the U-shaped handrail 10. Meanwhile, when the U-shaped handrail 10 is moved up to the top (see FIG. 3), the handrail 10 is considerably turned to the other side of the frame 30 in a hung state at a locked angle. Therefore, the frame 30 won't be unexpectedly collapsed even in case of being moved. The frame 30 can only be lowered by moving the U-shaped handrail 10 in proper operation steps so that the safety is more ensured.

In order to facilitate the movement of the strong rope 70, a plurality of locating rolls 71 are disposed on the supporting arms 20. This belongs to prior art so that further descriptions won't be given.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A folding mechanism for an exercise treadmill comprising a U-shaped handrail, two supporting arms, a frame, a front support, a motorized assembly and a rear treading plate;

wherein the improvement is characterized by:

said frame having a platform the front and rear ends of which are fitted with a front and rear rollers between which a treadmill walking belt circles, said rear roller of said frame being positioned on horizontal parts of said supporting arms by means of a first pivot;

said motorized assembly having a motor, a belt, a driven wheel and a protection cover, said motor being fixed behind said horizontal parts of said supporting arms by means of a fastening member, said belt extending between a power output shaft and said driven wheel while said rear roller is driven by said driven wheel for a rotational movement of said treadmill walking belt; and each end of said U-shaped handrail being provided with a rope wheel whose shaft is pivotably mounted on said extension part at the top of each of said supporting arms; a strong rope being thereafter fixed at one side of said rope wheel and pulled downward to said bottom of said frame so that, when said U-shaped handrail is raised and turned around said shaft, said rope wheel is also rotated to pull said strong rope upward while said frame is raised up to the top by means that said rear roller is turned around said first pivot.

2. A folding mechanism for an exercise treadmill comprising:

a) two upwardly extending supporting arms each including horizontal portions;

b) a frame having a treadmill walking belt thereon, the frame pivotally connected to the horizontal portions of the supporting arms at a first pivot axis so as to be movable between a use position and a storage position;

c) a handrail pivotally connected to upper portions of the two supporting arms at a second pivot axis so as to be pivotable between first and second positions; and, d) an elongated, flexible member attached to the handrail and to the frame whereby movement of the handrail between the first and second positions causes movement of the frame between the use and storage positions.

3. The folding mechanism for an exercise treadmill as recited in claim 2, wherein said elongated flexible member comprises a rope.

* * * * *